United States Patent [19]

Kawaura

[11] Patent Number: 4,986,679

[45] Date of Patent: Jan. 22, 1991

[54] MECHANISM FOR DETECTING PRESENCE OF RIBBON STOPPER IN A RIBBON CASSETTE USED IN A PRINTER

[75] Inventor: Masafumi Kawaura, Nagoya, Japan

[73] Assignee: Brother Kogyo Kabushiki Kaisha, Aichi, Japan

[21] Appl. No.: 473,459

[22] Filed: Feb. 1, 1990

[30] Foreign Application Priority Data

Feb. 8, 1989 [JP] Japan ..... 1-13661[U]

[51] Int. Cl.[5] ..... B41J 32/02

[52] U.S. Cl. ..... 400/208; 400/194; 400/703; 400/668; 400/663; 400/196.1

[58] Field of Search ..... 400/194, 195, 196, 196.1, 400/197, 198, 200, 201, 202, 202.1, 202.2, 202.3, 202.4, 207, 208, 208.1, 663, 668, 674, 675, 703

[56] References Cited

U.S. PATENT DOCUMENTS

| | | | |
|---|---|---|---|
| 4,228,884 | 10/1980 | Michels | 192/135 |
| 4,301,957 | 11/1981 | Shore | 226/118 |
| 4,408,910 | 10/1983 | Masao | 400/207 |
| 4,511,271 | 4/1985 | Oberto | 400/208 |
| 4,511,903 | 4/1985 | Miyazaki et al. | 400/207 |
| 4,732,499 | 3/1988 | Nojima | 400/208 |

FOREIGN PATENT DOCUMENTS

| | | | |
|---|---|---|---|
| 161399 | 11/1985 | European Pat. Off. | 400/208 |
| 56290 | 4/1982 | Japan | 400/196.1 |
| 169881 | 9/1984 | Japan | 400/208 |
| 291168 | 4/1986 | Japan | 400/196.1 |
| 181671 | 8/1986 | Japan | 400/668 |

OTHER PUBLICATIONS

IBM Technical Disclosure Bulletin, "Packaging for Printer Ribbon Cartridges", Hosie and Toutant, vol. 24, No. 5, pp. 2518-2519.

*Primary Examiner*—Edgar S. Burr
*Assistant Examiner*—Joseph R. Keating
*Attorney, Agent, or Firm*—Oliff & Berridge

[57] ABSTRACT

In a printer of the type in which printing is carried out on a recording medium with a print element through an ink ribbon interposed between the print element and a sheet or paper, a ribbon cassette accommodating therein the ink ribbon has a ribbon stopper removably provided for limiting the movement of the ink ribbon within the ribbon cassette. A switch is provided for detecting the presence of the ribbon stopper in the ribbon cassette when the ribbon cassette is mounted on the printer. If the ribbon stopper is detected by the switch, then a ribbon feed motor is not energized so that the ink ribbon is not withdrawn from the ribbon cassette. Thus, the ink ribbon will not be cut off, which may otherwise be caused if the ribbon is forcibly withdrawn without removing the ribbon stopper.

19 Claims, 2 Drawing Sheets

MECHANISM FOR DETECTING PRESENCE OF RIBBON STOPPER IN A RIBBON CASSETTE USED IN A PRINTER

BACKGROUND OF THE INVENTION

The present invention relates generally to a printer in which printing is carried out on a recording medium through an ink ribbon which is withdrawn from and circulated into a ribbon cassette More particularly, the invention relates to a mechanism for detecting presence of a ribbon stopper used to tightly retain the ink ribbon in the cassette.

An ink ribbon cassette is typically used in dot impact printers, in which an endless loop ink ribbon is retained. For allowing the ribbon to be smoothly fed out from the cassette when printing is carried out, the ink ribbon is sinuously folded and loosely retained in the storage chamber of the ribbon cassette. If, in the ink ribbon loosely retained condition, the ribbon cassette is packed, shipped or distributed, the ink ribbon tends to be moved or turned over within the cassette, thereby causing a jam in the storage chamber. To avoid such a problem, the ink ribbon is held relatively tightly at one end of the storage chamber and is kept unmoved by a ribbon stopper located substantially at the center of the storage chamber. The ribbon stopper is not removed until the ink ribbon is actually used.

The ribbon stopper has to be removed when the ribbon cassette is mounted on a printer. However, since the users may not be aware of the existence of the ribbon stopper or otherwise not accustomed to the process of removing the ribbon stopper, they tend to forget to remove the ribbon stopper. If the printer is operated under the condition where the ribbon cassette is mounted on the printer without removing the ribbon stopper, the ink ribbon will be cut off when it is forcibly withdrawn, since the movement of the ink ribbon is bothered by the ribbon stopper. As a result, the ribbon cassette can no longer be used despite it is new.

SUMMARY OF THE INVENTION

The present invention has been made to solve the aforementioned problem, and it is an object of the present invention to prevent a ribbon stopper of a ribbon cassette from being left unremoved.

To achieve the above and other objects, there is provided a printer for carrying out printing on a sheet of paper with a print element through an ink ribbon interposed between the print element and the sheet of paper, the ink ribbon being retained in a ribbon cassette in which a ribbon stopper is removably provided for limiting movement of the ink ribbon within the ribbon cassette, the ribbon cassette being detachably mounted on a printer body, the printer comprising a frame in which the printer body is housed, an ink ribbon feed mechanism for withdrawing the ink ribbon from the ribbon cassette, detecting means for detecting the presence of the ribbon stopper in the ribbon cassette when the ribbon cassette is mounted on the printer body, the detecting means outputting a first signal when the ribbon stopper is detected, and control means responsive to the first signal outputted from the detecting means for controlling the ink ribbon feed mechanism to inhibit the ink ribbon from being withdrawn from the ribbon cassette. The detecting means outputs a second signal when the absence of the ribbon stopper is detected when the ribbon cassette is mounted on the printer body, and the control means controls the ink ribbon feed mechanism to withdraw the ink ribbon from the ribbon cassette in response to the second signal.

When the ribbon cassette is mounted on the printer, the detecting means determines whether the ribbon stopper is present in the ribbon cassette or not, and prevents the ink ribbon feed mechanism from withdrawing the ink ribbon from the ribbon cassette if the ribbon stopper is detected. Therefore, the ink ribbon is prevented from being erroneously cut off even if the user intends to start printing without removing the ribbon stopper, and thus the ribbon cassette is prevented from becoming useless.

According to another aspect of the present invention, there is provided a printer for carrying out printing on a sheet of paper with a print element through an ink ribbon interposed between the print element and the sheet of paper, the ink ribbon being retained in a ribbon cassette in which a ribbon stopper is removably provided for limiting movement of the ink ribbon within the ribbon cassette, the ribbon cassette being detachably mounted on a printer body, the printer comprising a frame in which the printer body is housed, an ink ribbon feed mechanism coupled to the ribbon cassette, the mechanism withdrawing the ink ribbon from the ribbon cassette when actuated, a cover member attached to the frame to be movable between an open position and a closed position, means for preventing the cover member from being moved to the closed position when the ribbon stopper is provided in the ribbon cassette, and means for inhibiting the feed mechanism from being actuated when the preventing means prevents the cover member from moving to the closed position.

The above and other objects, features and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENT

The expression "front" and "rear" are used throughout the description to define the various parts when the printer is disposed in an orientation in which it is intended to be used.

Figure 1:
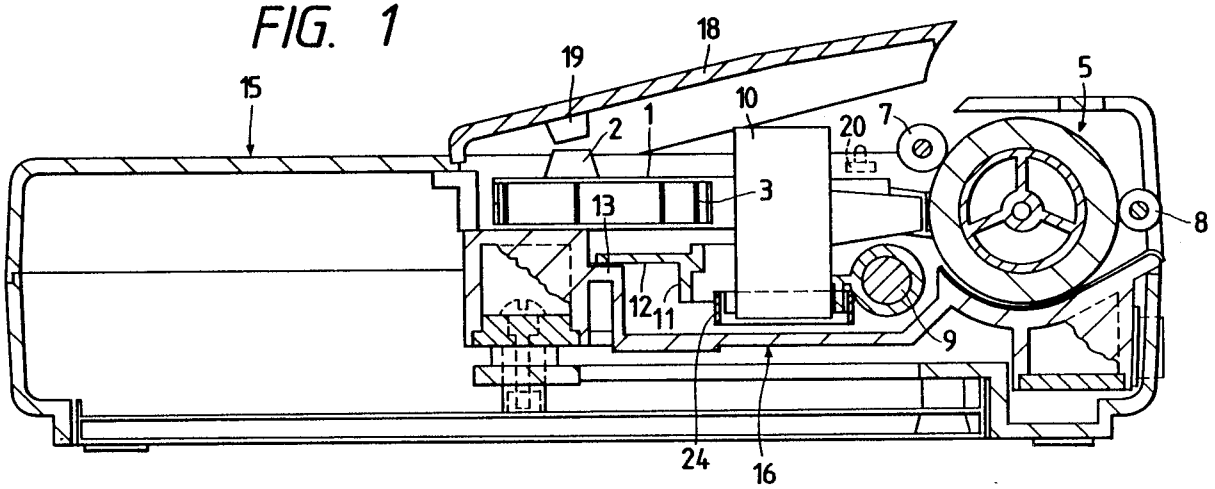
FIG. 1 is a vertical cross-sectional view showing a printer.

As shown in FIG. 1, a printer includes a printer body, an outer frame 15 made of synthetic resin and an inner frame 16 made of synthetic resin disposed in the rear portion of the printer. The printer body is housed in the outer frame 15 and includes a platen 5 rotatably supported between opposite side walls of the inner frame 16. Front and rear sheet feed rollers 7, 8 are rotatably supported between the opposite side walls of the inner frame 16 in resilient contact with the peripheral surface of the platen 5. A guide rod 9 is also supported between the opposite side walls in a position frontwardly of the platen 5. The printer body further includes a carriage 11 with a print head 10 mounted thereon. The carriage 11 is laterally movably supported on the guide rod 9. A guide member 12 projects forwardly from the front surface of the carriage 11 and engages a guide surface 13 on the inner frame 16.

An endless toothed belt 24 is wound around pulleys and trained in parallel to the longitudinal direction of the platen 5. The toothed belt 24 has a portion fixed to the carriage 11. When a drive pulley (not shown) is rotated, the toothed belt 24 is circulated to move the carriage 11 laterally along the guide rod 9. During the movement of the carriage 11, the print head 10 carries out printing on a sheet of print paper (not shown) supported on the platen 5.

Figure 2:
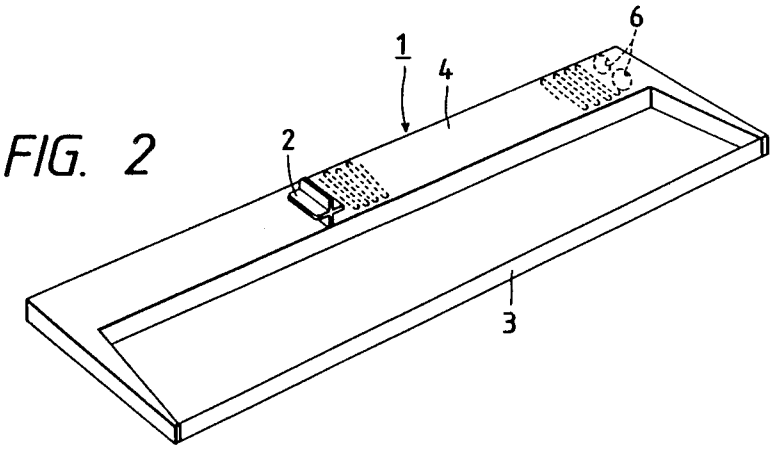
FIG. 2 is a perspective view showing a ribbon cassette to be used in the printer shown in FIG. 1.

A ribbon cassette 1 accommodating an ink ribbon 3 therein is detachably mounted on the inner frame 16. A part of the ink ribbon 3 withdrawn from the ribbon cassette 1 is interposed between the platen 5 and the print head 10. As shown in FIG. 2, the ribbon cassette 1 has a storage chamber 4 in the form of a hollow rectangular parallelepiped for storing the ink ribbon 3. The ink ribbon 3 which is regularly folded is stored in the storage chamber 4. A ribbon stopper 2 having a criss-cross cross section is detachably mounted substantially centrally of the storage chamber 4, and projects through a slit-like opening defined in the upper surface of the storage chamber 4. The ribbon stopper 2 serves to prevent the ink ribbon 3 from being moved or turned over in the storage chamber 43, thus preventing jamming of the ink ribbon, when the ribbon cassette is packed, shipped or otherwise in a distribution process. The ribbon stopper 2 positions the ink ribbon 3 in one side of the storage chamber 4 in a relatively tightly folded condition, thereby limiting the movement of the ribbon 3 within the storage chamber 4.

A pair of rollers 6 are disposed in the storage chamber 4 at one end thereof. By rotating the rollers 6, the ink ribbon 3 can be withdrawn from the storage chamber 4 through one side thereof and fed back into the storage chamber 4 through the other side thereof.

A cover 18 of the printer is hinged on the outer frame 15 to cover the ribbon cassette 4 and the print head 10. The cover 18 has a projection 19 on its reverse side in confronting relation to the ribbon stopper 2.

Figure 3:
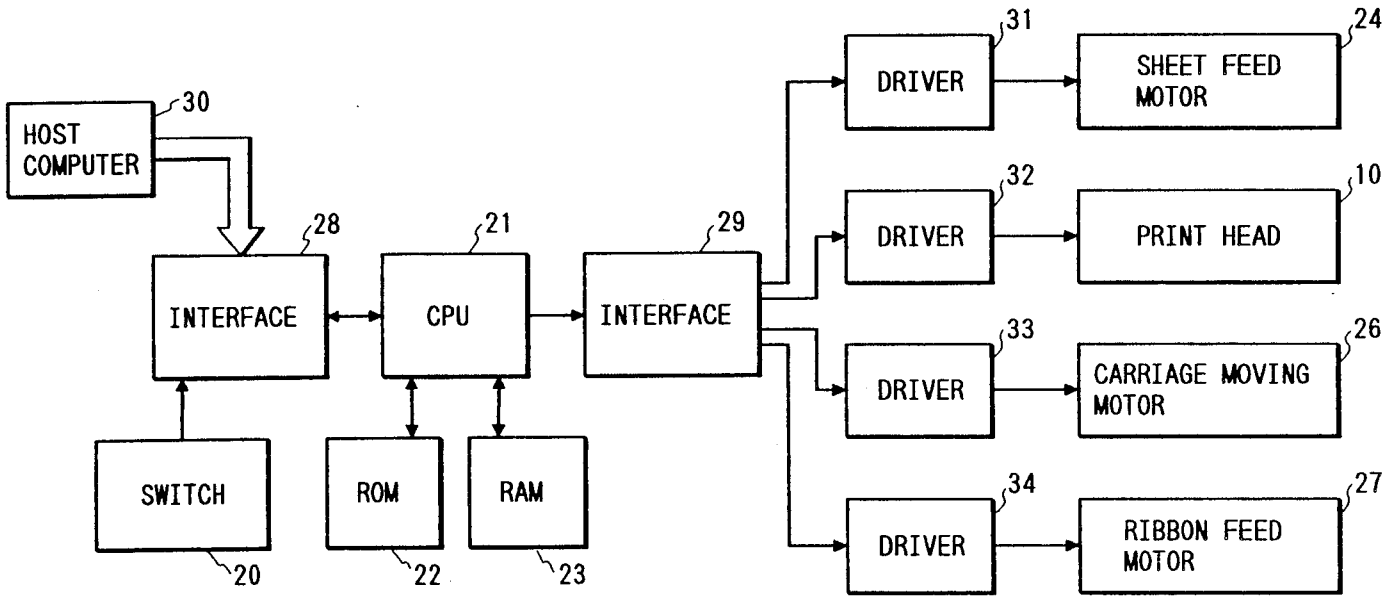
FIG. 3 is a block diagram of an electric circuit incorporated in the printer.

FIG. 3 shows a block diagram of an electronic circuit incorporated in the printer. A central processing unit (CPU) 21 for controlling the operation of the printer is connected to a read-only memory (ROM) 22 in which stored are various control programs for carrying out printing and a program for controlling the operation of the printer. The CPU 21 is further connected to a random access memory (RAM) 23 having a storage area for temporarily storing printing data transmitted from a host computer 30. To the CPU 21, the host computer 30 and a switch 20 are connected through an interface 28. As shown in FIG. 1, the switch 20 is provided in confronting relation to a cover 18 which is movable between an open position and a closed position. The switch 20 is actuated when the cover 18 is fulled closed. That is, the switch 20 is turned on and off in response to the opening and closing of the cover 18. The switch 20, the projection 19 and the cover 18 serve as a detecting means.

Referring back to FIG. 3, the print head 10, a sheet feed motor 24, a carriage moving motor 26, and a ribbon feed motor 27 are connected to the CPU 21 through the respective drivers 31 through 34 and another interface 29. The ribbon feed motor 27 is disengageably connected to the rollers 6 in the ribbon cassette 1. When the ribbon feed motor 27 is energized, the rollers 6 are rotated to withdraw the ink ribbon 3. When the cover 18 is closed, the switch 20 is turned on and an ON-signal produced therefrom is received at the CPU 21 which then causes the sheet feed motor 24, the print head 10, the carriage moving motor 26, and the ribbon feed motor 27 to operate normally so as to effect a normal printing operation. If the ribbon cassette 1 with the ribbon stopper 2 is mounted on the printer and it is tried to close the cover 18, then the ribbon stopper 2 contacts the projection 19 positioned on the cover 18 in confronting relation to the ribbon stopper 2, and the cover 18 cannot fully be closed. Therefore, the switch 20 is not rendered ON and an OFF-signal is received at the CPU 21.

In FIG. 3, unless the ON-signal comes from the switch 20, the CPU 21 does not energize the ribbon feed motor 27, and hence the ink ribbon 3 is not withdrawn from the storage chamber 4. Accordingly, even if the user forgets to remove the ribbon stopper 2 and wants to withdraw the ink ribbon 32, the ink ribbon 32 could not be withdrawn and thus the cut off of the ink ribbon 3 can be prevented and the ribbon cassette 1 is prevented from becoming unusable or useless. On the other hand, if the ribbon cassette 1 from which the ribbon stopper 2 is removed is mounted on the printer, the cover 18 will be closed. Then, the CPU 21 receives the ON-signal and energizes the ribbon feed motor 27 so that the ink ribbon 3 is withdrawn from the storage chamber 4.

Although the above-described embodiment is arranged in such a manner that when the switch 20 is not turned on, the CPU 21 does not energize the ribbon feed motor 27, the printer may be arranged so that all or some of the sheet feed motor 24, the print head 10, and the carriage moving motor 26 are not energized insofar as the ribbon feed motor 27 is not energized.

Although the present invention has been described with reference to a specific embodiment, it should be understood that variety of changes and modifications may be made without departing from the scope and spirit of the invention.

What is claimed is:

1. A printer for carrying out printing on a sheet of paper with a print element through an ink ribbon interposed between the print element and the sheet of paper, the ink ribbon being retained in a ribbon cassette in which a ribbon stopper is removably provided for limiting movement of the ink ribbon within the ribbon cassette, the ribbon cassette being detachably mounted on a printer body, the printer comprising:

a frame in which the printer body is housed;

an ink ribbon feed mechanism for withdrawing the ink ribbon from the ribbon cassette;

detecting means for detecting the presence of the ribbon stopper in the ribbon cassette when the ribbon cassette is mounted on the printer body, said detecting means outputting a first signal when the ribbon stopper is detected; and control means responsive to the first signal outputted from said detecting means for controlling said ink ribbon feed mechanism to inhibit the ink ribbon from being withdrawn from the ribbon cassette.

2. A printer according to claim 1, wherein said detecting means for detecting the presence of the ribbon stopper in the ribbon cassette when the ribbon cassette is mounted on the printer body outputs a second signal when the absence of the ribbon stopper is detected and said control means controls said ink ribbon feed mechanism to withdraw the ink ribbon from the ribbon cassette in response to the second signal.

3. A printer according to claim 2, wherein said detecting means comprises switch means having first and second states, said switch means being at the first state and outputting the first signal when the presence of the ribbon stopper is detected, and said switch means being at the second state and outputting the second signal when the absence of the ribbon stopper is detected.

4. A printer according to claim 3, said detecting means further comprising a cover member attached to said frame to be movable between an open position and a closed position, and a projection provided on said cover member in confronting relation to the ribbon stopper, wherein when the ribbon stopper is present in the ribbon cassette, said cover member is prevented from being moved to the closed position and the presence of the ribbon stopper is thereby detected, and wherein when the ribbon stopper is absent in the ribbon cassette, said cover member is brought to the closed position and the absence of the ribbon stopper is thereby detected.

5. A printer according to claim 4, wherein said switch means is at the first state and outputs the first signal when said cover member is in a position other than the closed position, and wherein said switch means is at the second state and outputs the second signal when said cover member is in the closed position.

6. A printer according to claim 5, wherein said ribbon cassette has a storage chamber in the form of a hollow rectangular parallelepiped for storing the ink ribbon therein and the ribbon stopper is removably provided on an upper surface offset from but near a midpoint of a longer axis of the storage chamber.

7. A printer according to claim 6, wherein a slit-like opening is formed in the storage chamber and the ribbon stopper projects outwardly of the storage chamber through the slit-like opening.

8. A printer according to claim 7, wherein the ribbon stopper has a crisscross section.

9. A printer according to claim 6, wherein said ink ribbon feed mechanism comprises a pair of rollers disposed within the storage chamber for withdrawing the ink ribbon, and a motor operatively coupled to said pair of rollers for rotating said pair of rollers wherein said motor is controlled by said control means.

10. A printer for carrying out printing on a sheet of paper with a print element through an ink ribbon interposed between the print element and the sheet of paper, the ink ribbon being retained in a ribbon cassette in which a ribbon stopper is removably provided for limiting movement of the ink ribbon within the ribbon cassette, the ribbon cassette being detachably mounted on a printer body, the printer comprising:

a frame in which the printer body is housed;

an ink ribbon feed mechanism coupled to the ribbon cassette, said mechanism withdrawing the ink ribbon from the ribbon cassette when actuated;

a cover member attached to said frame to be movable between an open position and a closed position;

means for preventing said cover member from being moved to the closed position when the ribbon stopper is provided in the ribbon cassette; and means for inhibiting said feed mechanism from being actuated when said preventing means prevents said cover member from moving to the closed position.

11. A printer according to claim 10, wherein said preventing means comprises a projection provided on said cover member to be abutable with the ribbon stopper, wherein said cover member is prevented from being moved to the closed position when said projection is in abutment with the ribbon stopper.

12. A printer according to claim 11, wherein said inhibiting means comprises switch means having first and second states, said switch means being at the first state and outputting a first signal when said projection is in abutment with the ribbon stopper, said switch means being at the second state and outputting a second signal when said projection is out of abutment with the ribbon stopper, and control means responsive to the first signal for controlling said ink ribbon feed mechanism to deactuate said ink ribbon feed mechanism.

13. A printer according to claim 12, wherein said control means controls said ink ribbon feed mechanism to actuate the latter in response to the second signal.

14. A printer according to claim 13, wherein said ribbon cassette has a storage chamber in the form of a hollow rectangular parallelepiped for storing the ink ribbon therein and the ribbon stopper is removably provided substantially centrally of the storage chamber.

15. A printer according to claim 14, wherein a slit-like opening is formed in the storage chamber and the ribbon stopper projects outwardly of the storage chamber through the slit-like opening.

16. A printer according to claim 15, wherein the ribbon stopper has a crisscross section.

17. A printer according to claim 16, wherein said ink ribbon feed mechanism comprises a pair of rollers disposed within the storage chamber for withdrawing the ink ribbon, and a motor operatively coupled to said pair of rollers for rotating the latter, wherein said motor is controlled by said control means.

18. A printer for carrying out printing on a sheet of paper with a print element, the printer comprising:

a printer body;

a frame in which the printer body is housed;

an ink ribbon cassette detachably mounted on said printer body;

an ink ribbon retained within the ink ribbon cassette;

a ribbon stopper removably provided in said ribbon cassette for limiting movement of said ink ribbon;

an ink ribbon feed mechanism for withdrawing the ink ribbon from the ribbon cassette;

detecting means for detecting the presence of the ribbon stopper in the ribbon cassette when the ribbon cassette is mounted on the printer body and outputting a first signal when the ribbon stopper is detected; and control means responsive to the first signal outputted from said detecting means for controlling said ink ribbon feed mechanism to inhibit the ink ribbon from being withdrawn from the ribbon cassette.

19. A printer for carrying out printing on a sheet of paper with a print element, the printer comprising:

a printer body;

a frame in which the printer body is housed;

an ink ribbon cassette detachably mounted on the printer body;

an ink ribbon retained within the ink ribbon cassette;

a ribbon stopper removably provided in said ribbon cassette for limiting movement of said ink ribbon;

an ink ribbon feed mechanism coupled to the ribbon cassette, the ink ribbon feed mechanism withdrawing the ink ribbon from the ribbon cassette when actuated;

a cover member attached to the frame to be movable between an open position and a closed position;

means for preventing said cover member from being moved to the closed position when the ribbon stopper is provided in the ribbon cassette mounted on the printer body; and means for inhibiting said feed mechanism from being actuated when said preventing means prevents said cover member from moving to the closed position.

* * * * *